US006259876B1

(12) United States Patent
Fukuda et al.

(10) Patent No.: US 6,259,876 B1
(45) Date of Patent: Jul. 10, 2001

(54) DEVELOPING DEVICE AND AN IMAGE FORMING APPARATUS USING THE DEVELOPING DEVICE

(75) Inventors: Yoshiyuki Fukuda; Toshimi Yamashita, both of Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/185,031

(22) Filed: Nov. 3, 1998

(30) Foreign Application Priority Data

Dec. 3, 1997 (JP) ..... 9-332955

(51) Int. Cl.[7] ..... G03G 15/08

(52) U.S. Cl. ..... 399/254; 399/272; 399/273

(58) Field of Search ..... 399/254, 256, 399/272, 273, 274; 366/241, 279, 292, 297, 300

(56) References Cited

U.S. PATENT DOCUMENTS 4,940,014 * 7/1990 Saijo et al. ..... 399/256
5,987,280 * 11/1999 Sato et al. ..... 399/254 X
5,991,583 * 11/1999 Nozawa ..... 399/254

FOREIGN PATENT DOCUMENTS 61-077877 * 4/1986 (JP) .
5-333691 12/1993 (JP) .

* cited by examiner

*Primary Examiner*—Sophia S. Chen
(74) *Attorney, Agent, or Firm*—Foley & Lardner

(57) ABSTRACT

The developing device of the present invention includes a developing magnet roller to supply developer to images to be developed, a first conveying auger arranged with a specified gap provided between the developing magnet roller to convey developer while stirring in the first longitudinal direction and supply developer to the developing magnet roller and a second conveying auger provided below the first conveying auger to receive developer conveyed from the first conveying auger and convey this received developer while stirring in the second longitudinal direction that is reverse to the first longitudinal direction and convey developer by circulating between the first conveying auger. This developing device further includes a housing to house the first conveying auger and developer so as to uniformly supply it to the developing magnet roller along the longitudinal direction irrespective of the developer accumulate height along the longitudinal conveying direction by the first conveying auger.

12 Claims, 9 Drawing Sheets

DEVELOPING DEVICE AND AN IMAGE FORMING APPARATUS USING THE DEVELOPING DEVICE

BACKGROUND OF THE INVENTION

1. Field of the Invention

The present invention relates to a developing device for forming a developer image on an image carrier and an image forming apparatus using the developing device.

2. Description of the Prior Art

In the case of image forming apparatus, for instance, an electro-photographic copying machine, the downsizing of the main body is expected in order to save a required space. In particular, in the case of full-color electro-photographic copying machines, as a plurality of developing devices are used, the downsizing is eagerly demanded.

In the case of developing devices comprising such image forming apparatus, two conveying augers are horizontally arranged in two rows in the housing. These conveying augers are rotated and a two-component developer comprising toner and carrier is stirred, circulated, conveyed and supplied to a magnet roller.

However, when the augers are arranged in a row horizontally, a space required for installing the apparatus becomes large and therefore, the downsizing of the apparatus was achieved by arranging two conveying augers at upper and lower positions.

For instance, the Japanese Patent Disclosure (Kokai) No. 5-333691 discloses a developing device, which has a developer conveying route comprising two conveying paths; the upper and lower conveying paths by arranging a conveying auger at the upper and lower locations of a partition plate, respectively to convey developer received from the upper conveying path while stirring it and supply developer to a magnet roller and recover the developer from the magnet roller into the lower conveying path.

Now, the tip of the partition plate dividing the upper and lower conveying paths in the developing device is extended between the magnet roller and the upper conveying auger and the top edge height is kept at the same height over the entire length in its longitudinal direction and formed horizontally.

The magnet roller is arranged at a position higher than the upper conveying auger and therefore, developer is supplied to the magnet roller by the conveying pole of the magnet provided to this roller itself.

In other words, while developer is being conveyed, a part of the developer is supplied to the magnet roller. The developer not used by the magnet roller is conveyed to the lower conveying path and recovered without being returned to the upper conveying path, which is the source of supply of developer.

So, in the upper conveying path, the developer accumulate height becomes gradually low toward the downstream of the conveying direction along the longitudinal direction. On the contrary, in the lower conveying path the developer accumulate height tends to gradually rise toward the downstream in the conveying direction along the longitudinal direction.

By such a difference of the developer accumulate height along the longitudinal direction in the upper and lower conveying paths, supply amount of developer to the magnet roller becomes uneven. In order to solve this defect it is desirable that the magnet roller is provided at a point higher than the upper conveying auger. However, if this condition is realized, the developing device will become long and large in the direction of height.

If the position of the magnet roller is lowered in order to make the developing device small in size, supply amount of developer to the magnet roller is determined by the position of a doctor blade, which controls the thickness of the developer layer and an accumulate height of supplied developer in the upper conveying path.

If the conveying amount of developer by the upper and lower conveying augers is made sufficiently large, the effect of the lowered position of magnet roller is reduced. On the other hand, however, if the conveying amount of developer by these augers is increased too large even little, stress to developer increases and furthermore, running torque increases and therefore, it is not possible to increase conveying amount of developer too large (less than 3 times according to the technique disclosed in the Japanese Patent Disclosure (Kokai) No. 5-333691).

Accordingly, in the range for practical use, the developer accumulate height in the upper and lower conveying paths is still inclined along the longitudinal direction. That is, when the magnet roller is lowered, amount of developer to be supplied to the magnet roller is subject to the effect of the accumulate height of developer along the longitudinal direction.

At the upper stream side of the conveying path, where the accumulate height is high, amount of developer is much and image density becomes high and at the downstream side, where the accumulate height is low, amount of developer is less and image density becomes low. As a result, there is a problem that a difference in density is produced between the left and right sides of an image.

SUMMARY OF THE INVENTION

It is an object of the present invention to provide a developing device, which is downsized, capable of obtaining a developer image of high quality by supplying developer uniformly to a developer supply means and an image forming apparatus using this developing device.

According to the present invention, a developing device is provided, which comprising a developer supply means to supply developer to latent images to be developed; a first conveying means arranged with a specified gap with said developer supply means to convey developer in the first longitudinal direction while stirring and supply to said developer supply means; a second conveying means provided below said first conveying means to receive developer conveyed from said first conveying means, convey this developer while stirring in the second longitudinal direction that is reverse to the first longitudinal direction and by circulating developer between the first conveying means; and a housing means to house said first conveying means and developer so as to supply developer uniformly to said developer supply means along the longitudinal direction irrespective of a difference in developer accumulate heights along the longitudinal direction of conveyance by said first conveying means.

Further, according to the present invention, an image forming apparatus is provided, which comprising: means to form electrostatic latent images on image carriers; developing means to develop electrostatic latent images formed by said latent image forming means; and transferring means to transfer developer images developed by said developing means on an image receiving medium; said developing means including: developer supply means to supply developer to said image carriers with electrostatic latent images formed; a first conveying means arranged with a specified gap provided between said developer supply means to convey developer in the first longitudinal direction while stirring and supply to said developer supply means; a second conveying means arranged below said first conveying means to receive developer carried out of the first conveying means, convey this developer in the second longitudinal direction that is reverse to the first longitudinal direction; and a housing means to house said first conveying means and developer so as to supply developer uniformly to said developer supply means along the longitudinal direction irrespective of a difference in the developer accumulate heights along the longitudinal direction conveyed by said first conveying means.

DETAILED DESCRIPTION OF THE PREFERRED EMBODIMENTS

Figure 1:
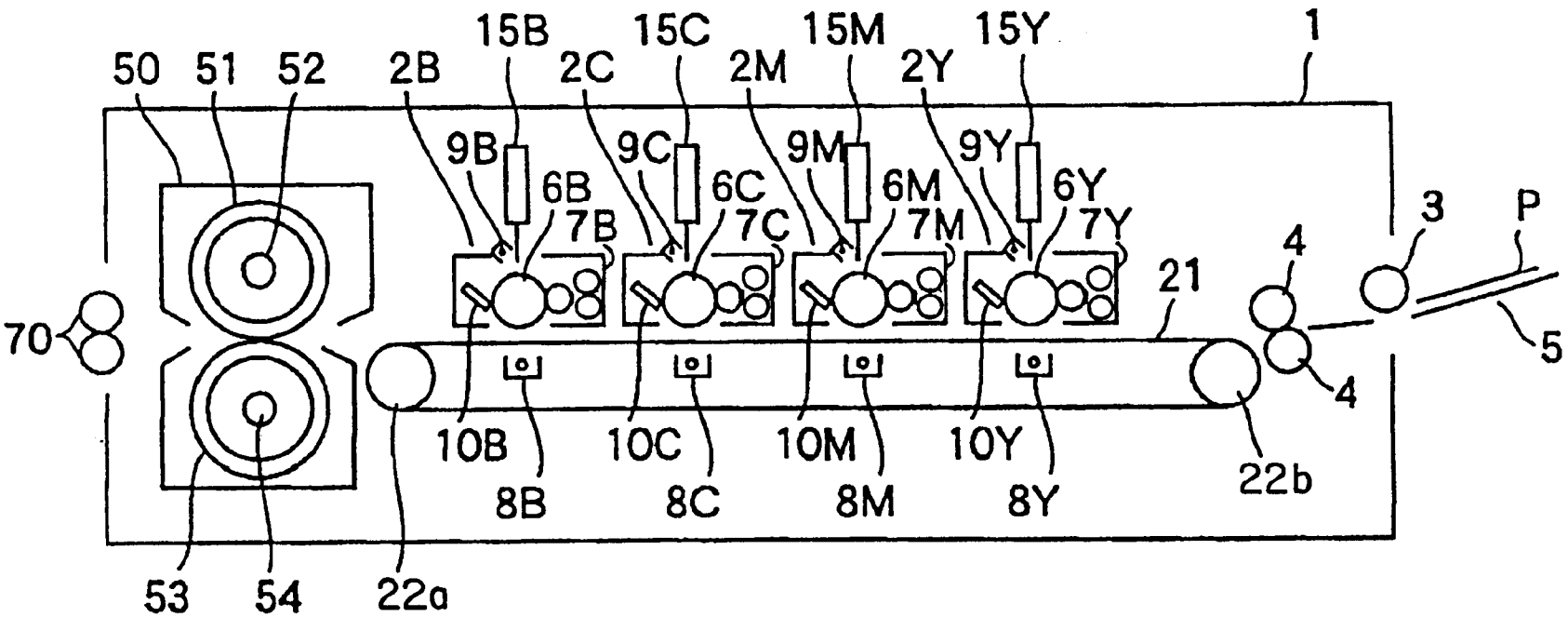
FIG. 1 is a schematic diagram showing one embodiment of an image forming apparatus using a developing device of the present invention.

Hereinafter, an embodiment of the present invention will be described with reference to the attached drawings.

At one side of a main body 1, there is provided a paper supply device 5 wherein sheets paper P are accumulated. A paper supply roller 3 provided to the paper supply device 5 feeds sheets of paper P one by one into the main body 1.

The paper P fed into the main body 1 from the paper supply device 5 is once stopped by an aligning roller pair 4 and aligned. Further, the paper P is conveyed on a transfer belt 21 by the rotation of the aligning roller 4.

The transfer belt 21 is made of a material that is stable from the thermal as well as abrasion resistive viewpoint, for instance, semiconductive polyimide. The transfer belt 21 is put over a driving roller 22*a* and a driven roller 22*b*. The driven roller 22*b* is applied with the tension so that the transfer belt 21 is moved without being slackened.

Above the transfer belt 21, there are provided process units 2Y, 2M, 2C and 2B. Yellow, magenta, cyan and black toners are used in the process units 2Y, 2M, 2C and 2B, respectively.

The process units 2Y, 2M, 2C and 2B are equipped with photo-conductive drums 6Y, 6M, 6C and 6B. Around the photo-conductive drums 6Y, 6M, 6C and 6B, main chargers 9Y, 9M, 9C and 9B, developing devices 7Y, 7M, 7C and 7B, transferring devices 8Y, 8M, 8C and 8B, cleaning devices 10Y, 10M, 10C and 10B and a charge eliminator (not shown) are arranged in order along the rotating direction.

The main chargers 9Y, 9M, 9C and 9B charge the surfaces of the photo-conductive drums uniformly.

The developing devices 7Y, 7M, 7C and 7B develop electrostatic latent images formed on respective photo-conductive drums and form toner images.

The transferring devices 8Y, 8M, 8C and 8B transfer the toner images formed on the photo-conductive drums on the paper P.

The cleaning devices 10Y, 10M, 10C and 10B remove toners remained on the photo-conductive drums after the toner images are transferred.

Further, in the process units 2Y, 2M, 2C and 2B, laser beam optical devices 15Y, 15M, 15C and 15B are arranged between the main chargers and the developing devices, respectively.

Inside the transfer belt 21, there are provided the transferring devices 8Y, 8M, 8C and 8B opposite to the photo-conductive drums 6Y, 6M, 6C and 6B in respective process units.

At the conveying end of the transfer belt 21, there is provided a fixing device 50. The fixing device 50 comprises a fixing roller 51 and a pressure roller 53 that is kept in contact with this fixing roller 51. In the fixing roller 51, a heat lamp 52 is built in and in the pressure roller 53, a heat lamp 54 is also built in.

At the paper conveying side of the fixing device 50, an exit roller pair 70 is arranged. The paper P conveyed from the exit roller pair 70 is ejected in a paper receiving tray (not shown) mounted at the side of the main body 1.

The paper P supplied from the paper supply device is conveyed in the direction of the process units by the aligning roller 4. At the proper timing with the rotation of the aligning roller 4, images are formed in the process units 2Y, 2M, 2C and 2B.

At this time, the transferring devices 8Y, 8N, 8C and 8B charge the transfer belt 21. By this charge, the paper P is conveyed in the state kept fitted to the transfer belt 21.

Hereinafter, the operation will be described taking the process unit 2Y using a yellow toner as an example.

The surface of the photo-conductive drum 6Y is uniformly charged to, for instance, about −700 V by the main charger 9Y. Then, the laser beam is applied to the photo-conductive drum 6Y from the laser beam optical device 15Y according to the image signal.

On the photo-conductive drum 6Y, as the resistance decreases only on the portion applied with the laser beam, the minus charge on that portion is eliminated and an electrostatic latent image is formed. Further, a semiconductor laser is normally used as a laser and the laser beam that is demodulated according to an image is scanned by a rotary polygon mirror (not shown).

The developing device 7Y develops the electrostatic latent image thus formed and a yellow toner image is formed. In other words, a yellow toner that is minus charged fine colored particle adheres to the portion of the electrostatic latent image on the photo-conductive drum 6Y when about −500 V developing bias is given. Thus, the electrostatic latent image becomes visible and a yellow toner image is formed.

The paper P is conveyed between the photo-conductive drum 6Y and the transfer belt 21 and the yellow toner image is transferred on the paper P by the transferring device 8Y. In the transferring device 8Y, for instance, about +1000 V charge is given from the back side of the paper P through the transfer belt 21. As a result, the toner image developed on the photo-conductive drum 6Y by the minus charged toner is attracted to the paper P and transferred thereon.

Similarly, magenta, cyan and black toner images are formed in order by the process units 2M, 2C and 2B. These toner images are transferred one above the other on the paper P by the transferring devices 8M, 8C and 8B.

The paper P is led between the fixing roller 51 heated by the heat lamp 52, and the pressure roller 53 heated by the heat lamp 54. The paper P is heated by the fixing roller 51 and the pressure roller 53 and the toner image on the paper P is fixed and the printing is completed.

Thereafter, the paper P is ejected on the receiving tray by the exit roller pair 70.

Further, on the photo-conductive drums 6Y, 6M, 6C and 6B, there are toners left without being transferred on the paper P. The cleaning devices 10Y, 10M, 10C and 10B scrape off these toners and the photo-conductive drums 6Y, 6M, 6C and 6B are cleaned.

Figure 2:
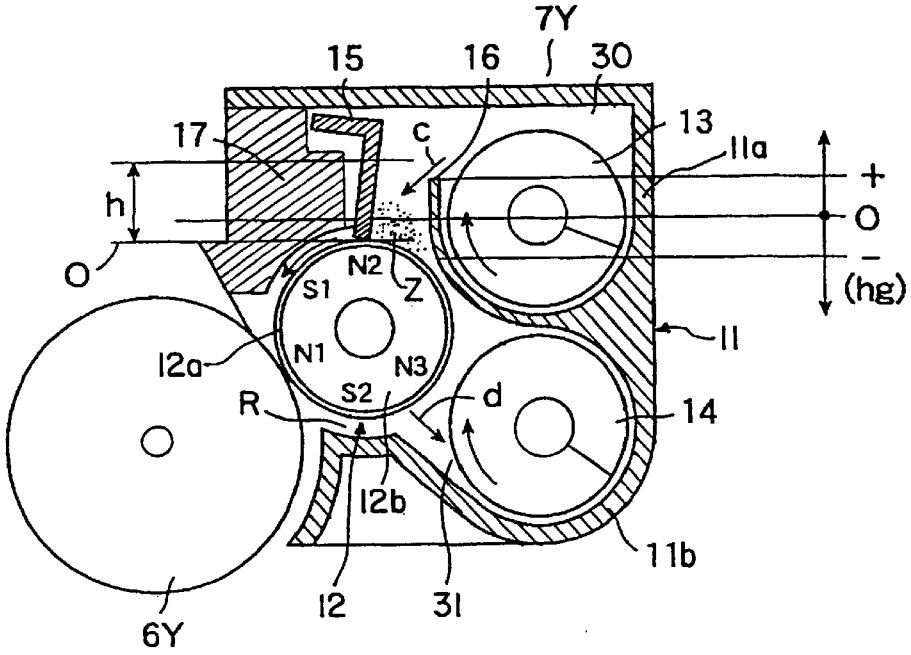
FIG. 2 is a schematic sectional view showing a developing device of the present invention.

FIG. 2 shows a sectional view of the above-mentioned developing device, for instance, 7Y and other developing devices 7M, 7C and 7B are in the entirely same structure.

The developing device 7Y comprises a housing 11 and a magnet roller 12, an upper conveying auger 13, a lower conveying auger 14 and a doctor blade 15 which are housed in the housing 11.

The magnet roller 12, which is a developer carrier, is provided opposite to the photo-conductive drum 6Y in the housing 11.

The upper conveying auger 13, which is a first developer conveying means, is arranged above the magnet roller 12, opposite to the magnet roller 12.

The lower conveying auger 14, which is a second developer conveying means, is arranged below the magnet roller 12, opposite to the magnet roller 12.

The doctor blade 15 is arranged with a narrow space provided between its top edge and the magnet roller 12, and controls amount of developer conveyed to the magnet roller 12.

Further, the housing 11 comprises an upper housing 11*a* to house the developer and the upper conveying auger 13 and a lower housing 11*b* to house the developer and the lower conveying auger 14.

The magnet roller 12 comprises a metallic cylindrical sleeve 12*a*, which is driven to rotate, and a plurality of magnets 12*b* of which magnetic poles (poles N1, S1, N2, S2, and N3 are shown in FIG. 2) are alternately fixed along the circumference in the sleeve 12*a*.

The upper housing 11*a* close to the magnet roller forms a leveler 16 which functions as a partition that is described later and the opening of the housing 11 is closed by a cover 17 to prevent leakage of the developer.

The leveler 16 is bent and extended upward so as to present between the sleeve 12*a* and the upper conveying auger 13.

Accordingly, the leveler 16 is in the shape to hold the lower half of the upper conveying auger 13 with a specified gap provided; in other word, the leveler 16 comprises a part of the upper housing 11*a* to house the upper conveying auger 13 in the half closed state.

Figure 4:
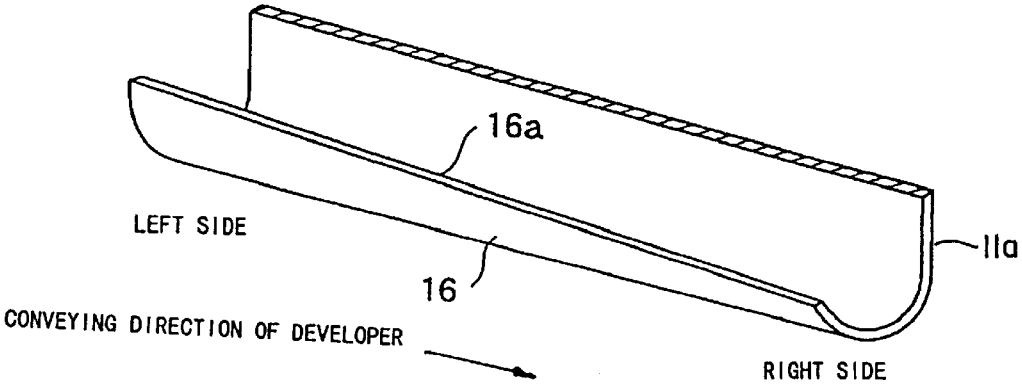
FIG. 4 is a perspective view showing an upper leveler of a developer container in the developing device shown in FIG. 2.

FIG. 4 shows the shape of the top portion of the leveler 16. The upper edge 16*a* of the top portion when viewed form the photo-conductive drum 6Y side is inclined so that the right side shown in this figure is low and the left side becomes high. That is, it is inclined so as to go down gradually in the developer conveying direction as described later. By adjusting the height of the upper edge 16*a* of the top portion and the angle of inclination as described later, supply amount of the developer to the sleeve 12*a* can be maintained at he optimum state.

Figure 5:
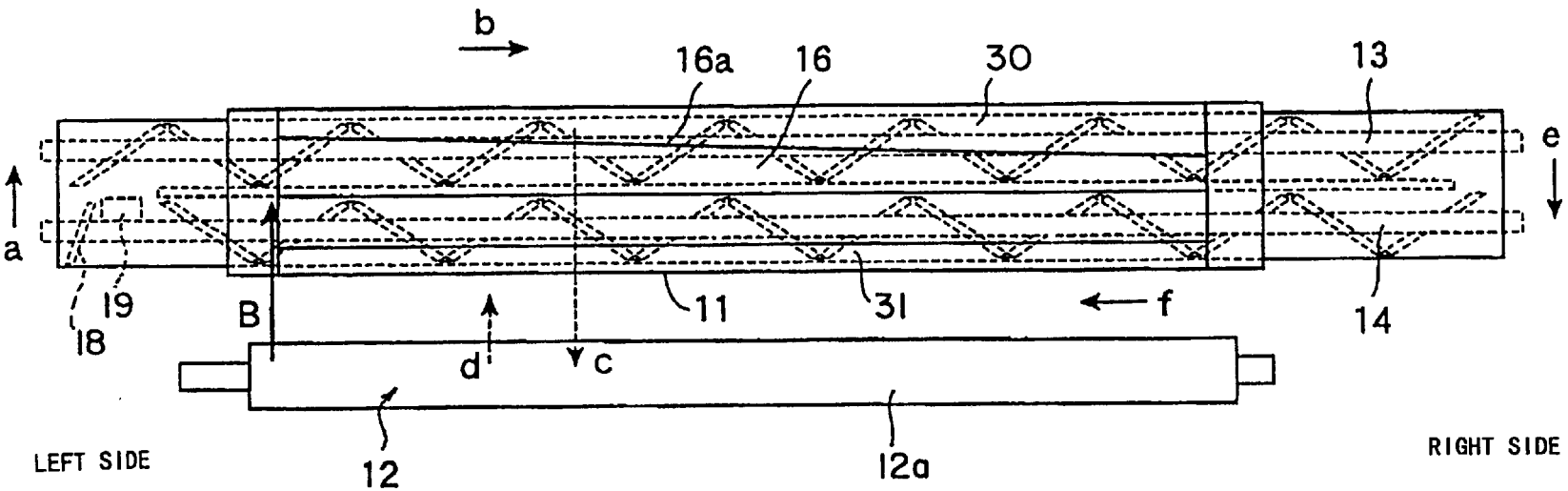
FIG. 5 is a schematic diagram showing the conveying route of a developer in the developing device shown in FIG. 2.

FIG. 5 shows the upper and lower conveying augers 13 and 14 viewed from the photo-conductive drum 6Y side shown in FIG. 2. In other words, what is shown here is the front view when the photo-conductive drum 6Y, the cover 17, the doctor blade 15 and the sleeve 12 were removed.

In the developing device 7Y, developer (not shown) in the amount of 50–80% of the entire system volume is contained. This developer is a two-component developing agent comprising a toner in particle size 6–11 $\mu$m (volume mean particle size) and carrier particle in particle size 30–80 $\mu$m (mean particle size). Toner density differs depending on selection of size but up to 3.5–10% is usable. Actually, a developer in toner particle 8 $\mu$m, carrier particle size 50 $\mu$m and toner density 6% is used.

Figure 3:
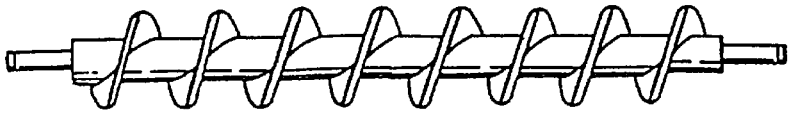
FIG. 3 is a front view showing an upper conveying auger used in the developing device shown in FIG. 2.

The upper and lower conveying augers 13 and 14 are formed in such a structure that a blade is wound round the shaft in the helical shape, the blade being in diameter of 18 mm and the helical pitch being 27 mm as shown in FIG. 3. In particular, the lower conveying auger 14 is provided with a return blade 18 and a paddle 19 at the left end to supply developer upward as shown in FIG. 5. The sleeve 12*a* is arranged at the position shown by the arrow B.

When the upper conveying auger 13 is rotated in the direction of the arrow shown in FIG. 2, the developer in the upper housing 11*a* is conveyed in the direction of the arrow b shown in FIG. 5 while being stirred by an upper conveying path 30 which is formed along the upper conveying auger 13.

When the lower conveying auger 14 is rotated in the direction of the arrow shown in FIG. 2, the developer in the lower housing 11*b* is conveyed in the direction of the arrow f shown in FIG. 5 while being stirred by a lower conveying path 31 which is formed along the lower conveying auger 14.

In other words, the developer is conveyed along the circulation route; the direction a by the return blade 18 and the paddle 19→the direction b along the upper conveying path 30→the direction e from the upper conveying path 30 to the lower conveying path 31; the direction f along lower conveying path 31; and →the direction a by the return blade 18 and the paddle 19.

Then, a part of the developer being conveyed through the upper conveying path 30 is supplied to around the sleeve 12*a* as shown by the arrow c. This developer is attracted by a magnetic pole N2 in a plurality of magnets 12*b* provided in the sleeve 12*a*.

When the sleeve 12*a* is rotated, the thickness of the developer layer is controlled by the doctor blade 15 and the developer is supplied between the photo-conductive drum 6Y and the sleeve 12*a*, which is the developing section.

As shown in FIG. 2, after the development, developer passes through a developer drawing-in portion R and is separated from the sleeve 12*a* along the arrow d by a magnetic pole N3 in a plurality of magnets 12*b* arranged in the sleeve 12*a*. The separated developer is recovered in the lower conveying path 31.

Thus, a part of the developer being conveyed through the upper conveying path 30 is supplied to the sleeve 12*a* and the remaining developer is conveyed to the lower conveying path 31 without being returned to the upper conveying path 30 and therefore, the developer is accumulated aslant along the conveying direction in the conveying paths 30 and 31.

Figure 6:
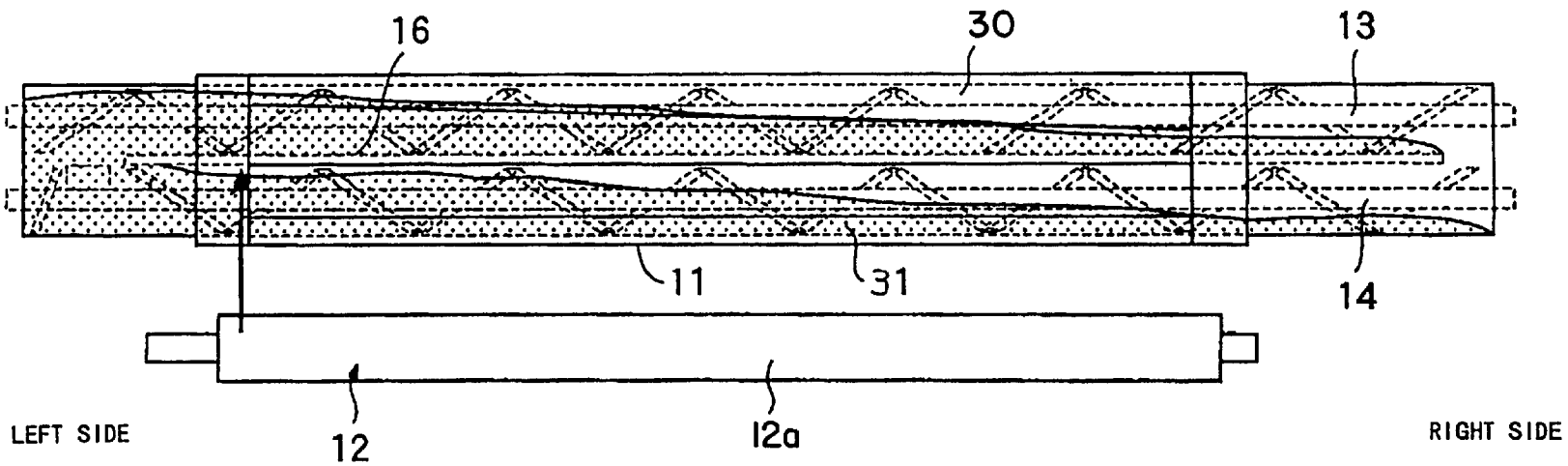
FIG. 6 is a schematic diagram showing the accumulated state of a developer in the developing device shown in FIG. 2.

The accumulated state of the developer is as shown in FIG. 6. In the upper conveying path 30, the developer is accumulated aslant high at the left side and low at the right side. In the lower conveying path 31, the developer is accumulated aslant high at the left side and low at the right.

Figure 7A:
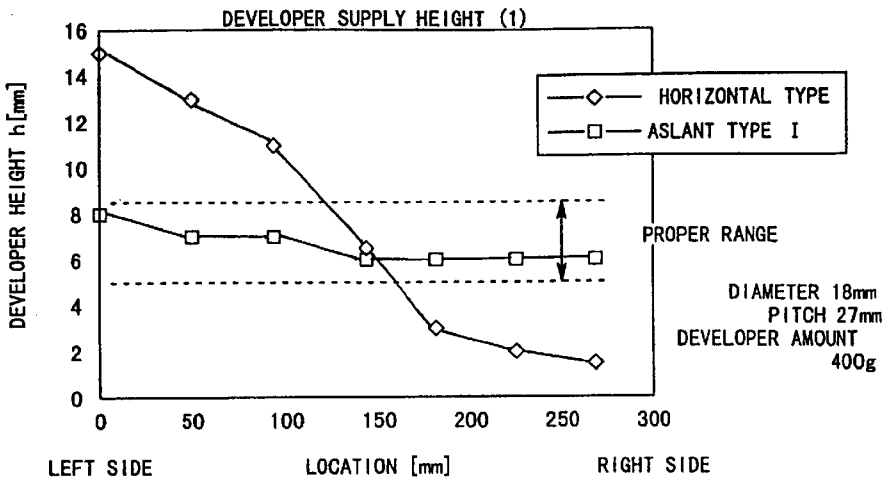
FIGS. 7A–7C are graphs showing the height of developer to the upper leveler position in the developer container, respectively.

Therefore, if the top edge is horizontal along the longitudinal direction as in a conventional parting plate, a difference of 2 (the right side in FIG. 2)–5 mm (the left side in FIG. 2) is generated in the height h of developer at a developer accumulate portion Z (FIG. 2) near the doctor blade 15 as shown in FIG. 7A as the horizontal type.

Figure 8:
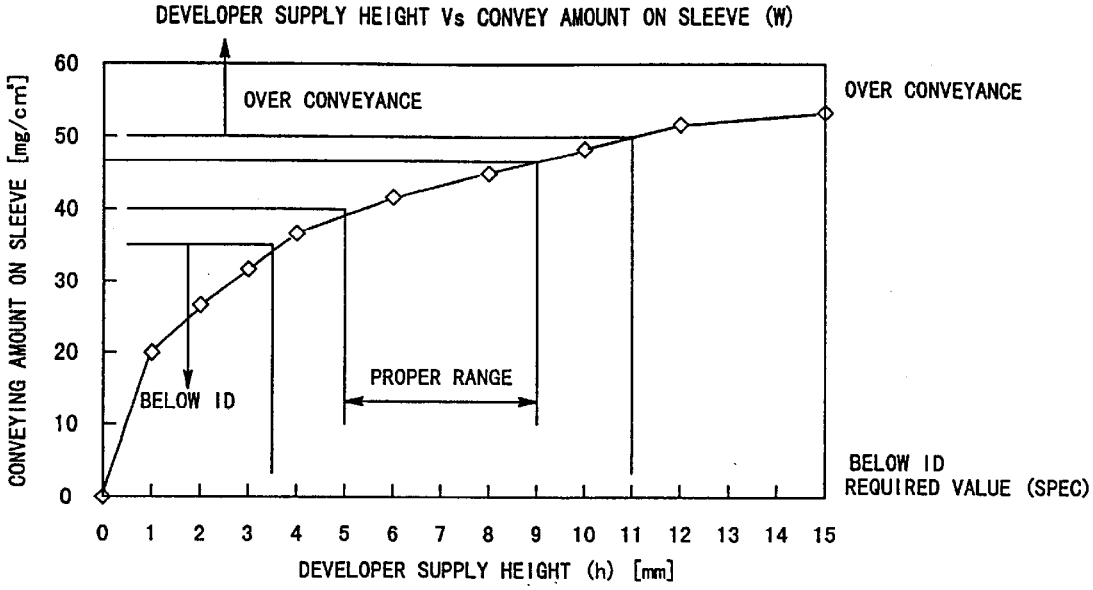
FIG. 8 is a graph showing the amount of developer conveyed to a sleeve corresponding to a developer supply height.

As shown in FIG. 8, such the difference affects the thickness of a developer layer on the sleeve 12*a* after the thickness of the developer layer is controlled by the doctor blade 15. That is, under this state, a difference of 28–55 mg/cm$^2$ is produced in the conveying amount of developer and the developer layer at the upper stream of conveyance (the left side in FIG. 8) where much developer is accumulated becomes thick (55 mg/cm$^2$). On the contrary, the developer layer at the downstream of the conveying path (the right side of FIG. 8) where less developer accumulates becomes thin (28 mg/cm$^2$).

Figure 9:
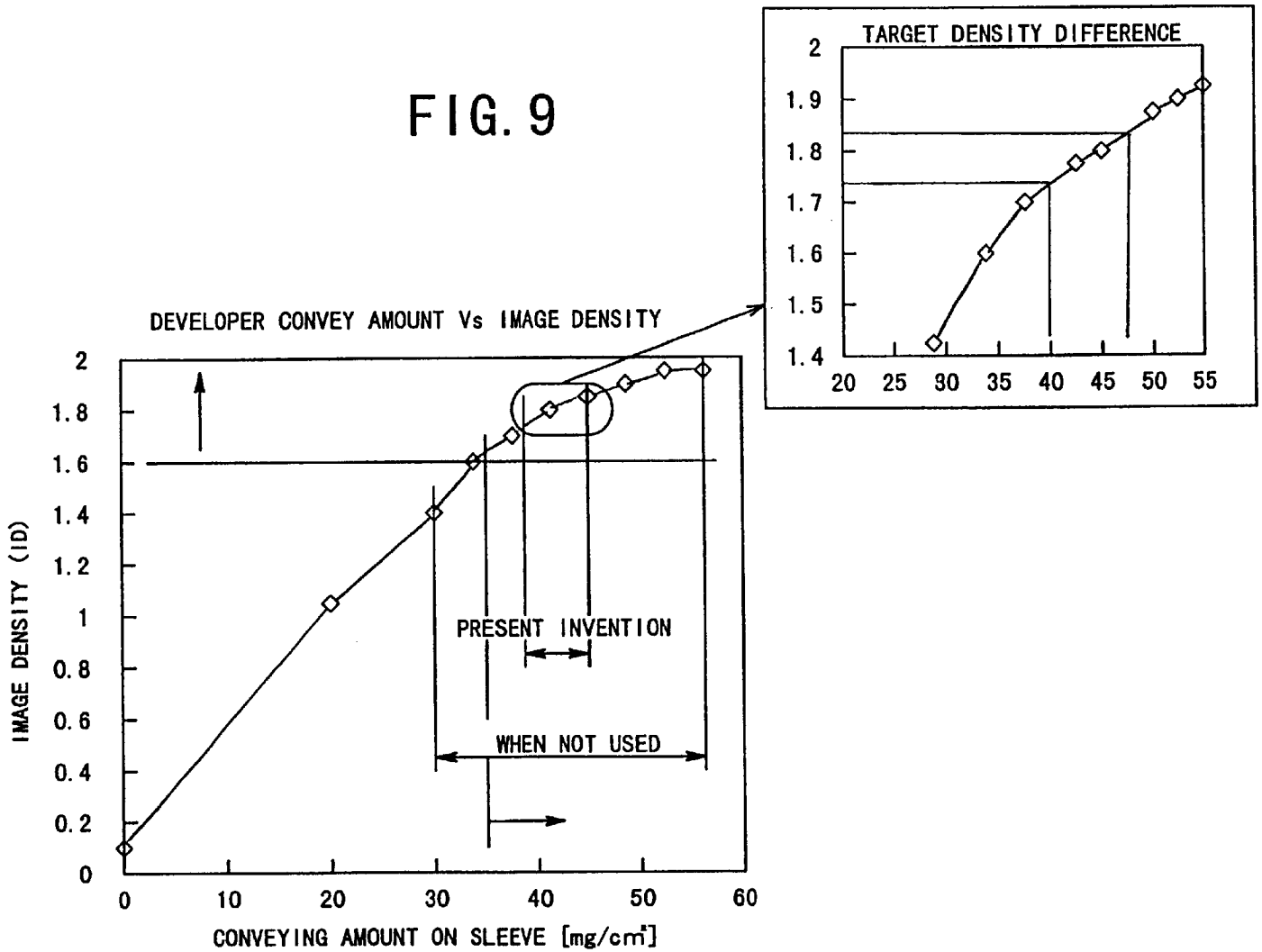
FIG. 9 is a graph showing the image density corresponding to the amount of developer conveyed to the sleeve.

Then, as a conventional defect, an image density (ID) becomes too large (ID: 1.95) at the thicker developer layer and it becomes insufficient (ID: 1.45) at the thinner developer layer as shown in FIG. 9. Accordingly, the density balance at the left and right sides becomes worse (Δ: 0.50) and becomes a factor causing the uneven density.

On the contrary, in the present invention the top edge 16*a* of the leveler 16 is inclined along the conveying direction of the upper conveying path 30 as described previously. That is, the height of the top edge 16*a* of the leveler 16 is regulated by the height hg from the axis of the upper conveying auger 13 and the left end in FIG. 2 is made high and the right end is made low so as to adapt to the inclination of the accumulated height of developer in the upper conveying path 30 by making the left end high and the right end low as shown in FIG. 2.

Furthermore, the top edge 16*a* of the leveler 16 is set lower than the accumulated developer height so as to maintain the supply amount of developer to the sleeve 12*a* constant. Definitely, as shown in FIG. 7A, under the conditions of the upper conveying auger in diameter of 18 mm, helical pitch 27 mm and amount of developer 400 g, a difference at the developer height h at the developer accumulate portion Z becomes 6 mm (the right side in FIG. 7A)–8 mm (the left side).

When a numerical value of this development height h is applied to FIG. 8, a development conveying amount to the sleeve 12*a* becomes 42–45 mg/cm$^2$. So, the change in image density (ID) drops to about Δ: 0.05 in FIG. 9 and uneven image destiny is scarcely recognized.

In the developing device 7Y of the present invention, the target is to reduce the image density to below Δ: 0.08 as shown by the target density difference in FIG. 9 and the target developer conveying amount to the sleeve 12 is 40–46 mg/cm$^2$ from FIG. 9 and its difference is Δ: 6 mg/cm$^2$. Further, as shown in FIG. 8, the target of developer supply height h at this time is 5–9 mm and its difference is Δ: 4 mm and this is in the proper range.

Figure 10A:
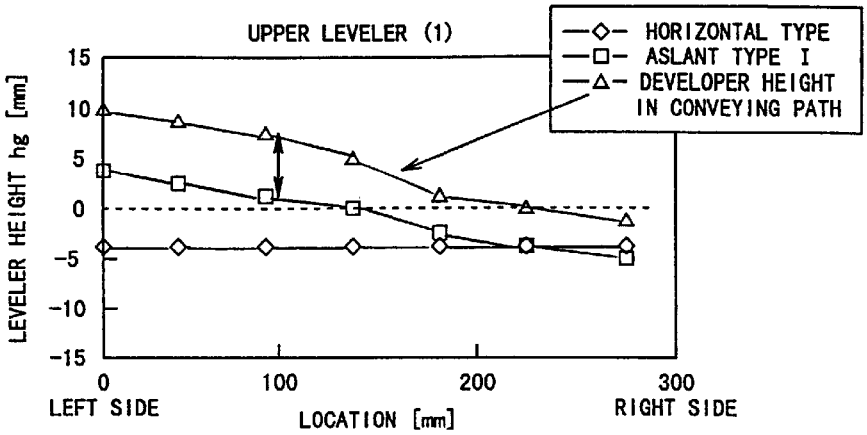
FIGS. 10A–10C are graphs showing the height of developer corresponding to the upper leveler position in the developer container, respectively.

Further, FIG. 10A shows the change in height along the longitudinal direction at the top edge 16*a* of the leveler 16 assuming the central position of the upper conveying auger 13 to be zero (0). Horizontal Type shown here is a conventional partition plate previously explained and Inclined Type I is the leveler 16 of the present invention.

Figure 10B:
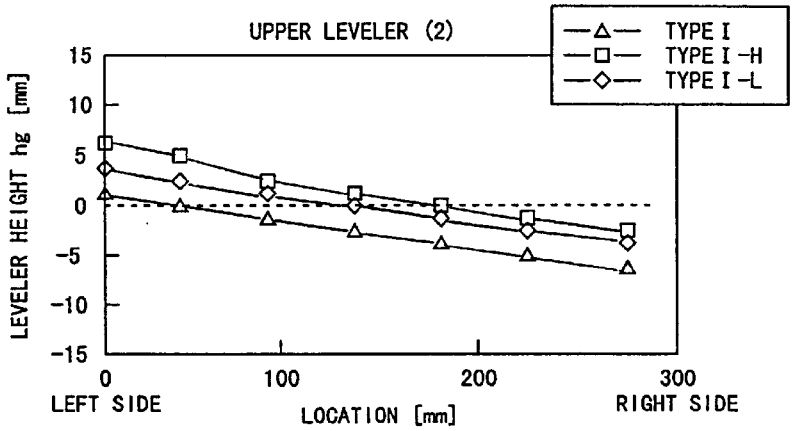

FIG. 10B shows Type I-H where the leveler 16 of above-mentioned Type I is used as the standard and the entire top edge 16*a* is made slightly higher than the leveler 16 in the same height and Type I-L where it is made slightly lower than the leveler 16.

Figure 10C:
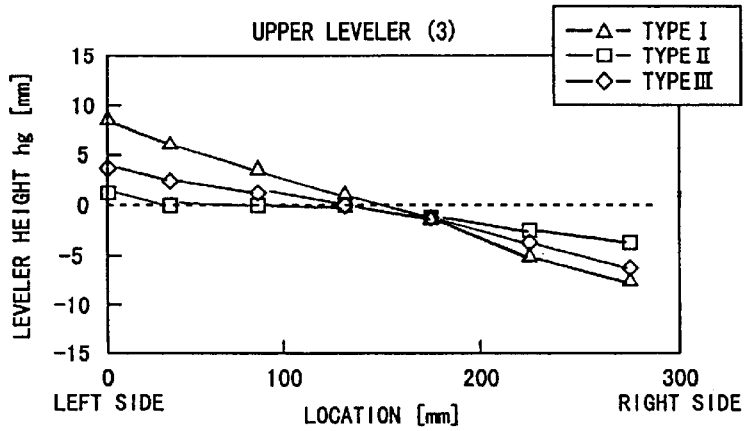

FIG. 10C shows Type II where the leveler 16 of Type I is made the standard and the angle of inclination along the longitudinal direction at the top edge 16*a* is made slightly gentle over the entire height and Type III where the angle of inclination along the longitudinal direction at the top edge 16*a* is made slightly sharp over the entire height.

Next, regarding the top edge 16*a* of the leveler 16, it will be explained that its proper shape changes according to amount of developer and helical pitch of the upper conveying auger 13, which conveys developer.

Figure 11A:
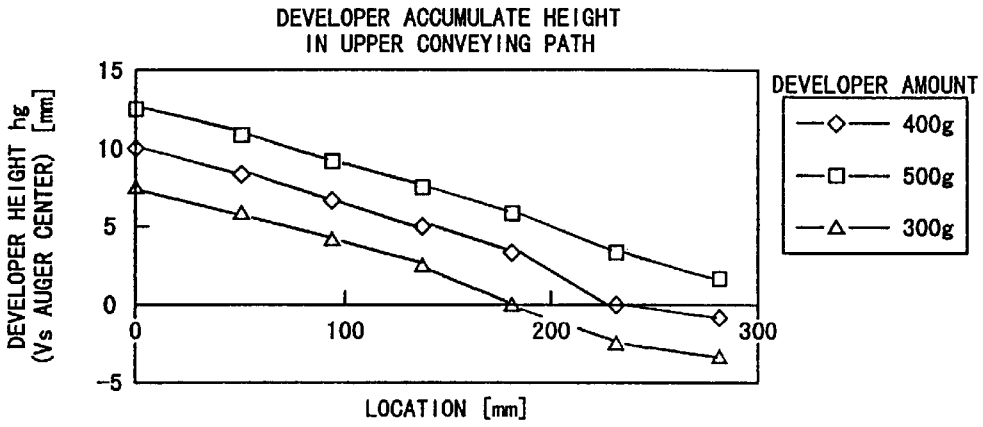
FIGS. 11A and 11B are graphs showing the developer agent accumulation height in the upper conveying path corresponding to the upper leveler height in the developer container, respectively.

In FIG. 11A, the accumulated height hg of developer in the upper conveying path 30 under different conditions of amount of developer; 400 g, 500 g and 300 g are shown. As clearly seen in FIG. 11A, developer accumulated in the state corresponding to its amount.

When amount of developer is increased, the accumulated height of developer in the upper conveying path 30 rises and the height h of developer before supply to the sleeve 12*a* at the developer accumulate portion Z rises and the over supply of developer will result. On the contrary, if amount of supply is reduced, the reverse phenomenon is produced and the supply of developer becomes insufficient.

Figure 7B:
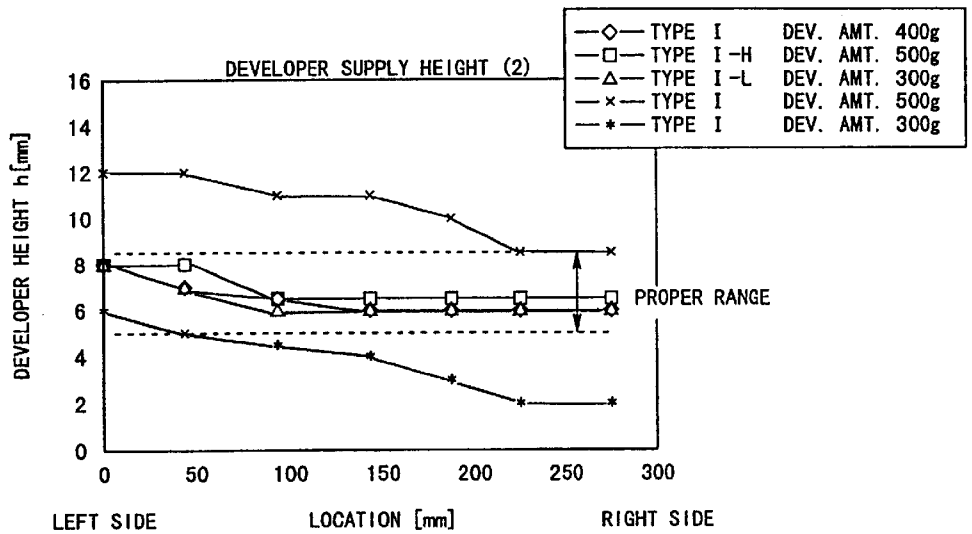

As measures against these over/short supply of developer, the height hg of the top edge 16*a* of the leveler 16 is changed according to the height of developer in the upper conveying path 30 shown in FIG. 11A; that is, the height hg becomes high when amount of developer is much (Type I-H) and becomes low when amount is less (Type I-L). Therefore, the height of developer h at the developer accumulate portion Z is made uniform and comes in the proper range as shown in FIG. 7B.

Figure 11B:
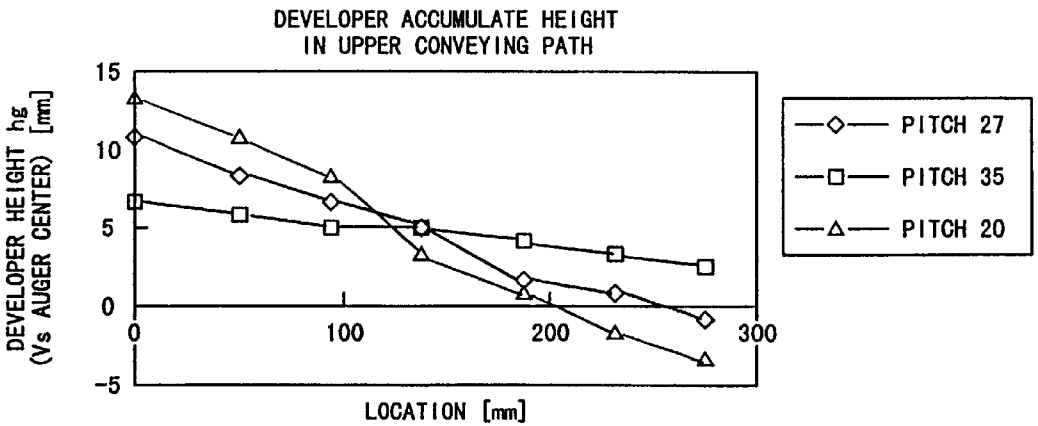

As shown in FIG. 11B, even under such conditions that the helical pitch of the blade plate comprising the upper conveying auger 13 is changed variously to, for instance, 27 mm, 35 mm and 20 mm, the accumulate height of developer varies.

In other words, the more rough the helical pitch is, the more fast the developer conveying speed becomes and a difference between the developer accumulate heights at the left and right sides in the upper conveying path 30 becomes small. On the contrary, the more fine the helical pitch is, the more slow the developer conveying speed becomes and a difference between the developer accumulate heights at the left and right sides in the upper conveying path 30 becomes large.

Furthermore, if amount of developer is 400 g, the upper leveler 16 is of Type I, the helical pitch of the upper conveying auger 13 is made fine and the conveying speed of developer is made slow, the developer height h rises at the left side and the conveying amount of developer becomes excessive while the height h falls at the right side and the conveying amount of developer becomes short.

On the other hand, when the helical pitch of the upper conveying auger 13 is made rough and the conveying speed of developer is made fast, the developer height h falls and the conveying amount of developer becomes short at the left side while the height h rises and the conveying amount of developer becomes excessive at the right side.

So, as shown in FIG. 11B, the helical pitch of the upper conveying auger 13 is selected according to the developer accumulate height hg in the upper conveying path 30. Definitely, as shown by Type III in FIG. 10C, the angle of inclination of the top edge 16*a* of the leveler 16 is changed and when the helical pitch of the upper conveying auger 13 is fine, the left side is raised and the right side is slightly lowered. Further, as shown by Type II in FIG. 11B, when the helical pitch of the upper conveying auger 13 is rough, the left side of the top edge 16*a* of the leveler 16 is lowered and the right side is raised.

Figure 7C:
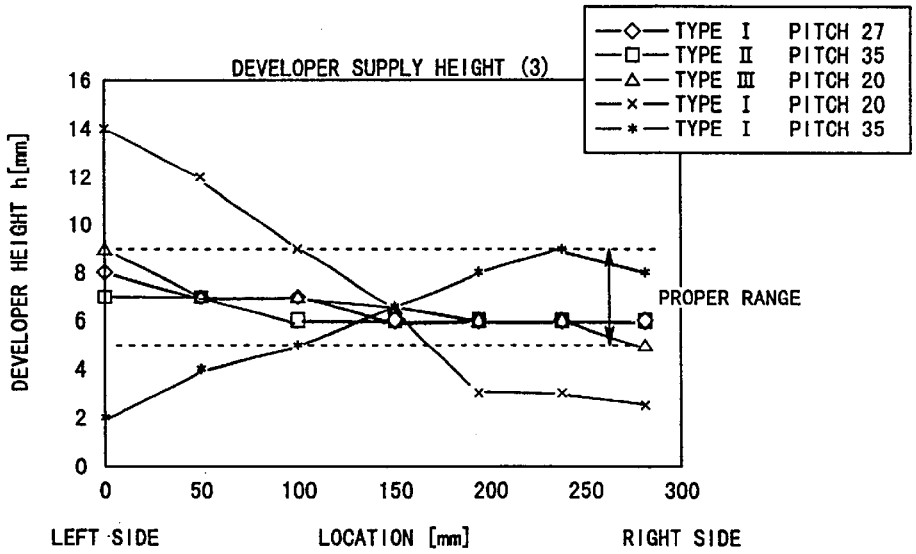

Accordingly, as shown in FIG. 7C, the developer height h before supplying developer to the sleeve 12*a* in the developer accumulate portion Z goes in the proper range, the stabilized developer conveyance is achieved, uneven density is reduced and stabilized.

Further, in the present invention it was concluded that the top edge 16*a* of the Type I leveler when the upper conveying auger 13 is in the diameter of 18 mm, the helical pitch is 27 mm and amount of developer is 400 g is proper. However, perceiving the above point, the shape of the leveler may be decided according to respective systems.

According to the present invention, the system has a developer conveying route in a structure that the means for stirring and conveying develop are arranged at the upper and lower locations, developer is supplied from the upper conveying path to the developer supply means and recovered from the developer supply means to the lower conveying path. Accordingly, the system has such effects that the system can be made small in size by lowering the developer supply means, uneven developer supply is reduced and images of high quality can be obtained.

What is claimed is:

1. A developing device comprising:

developer supply means for supplying developer to a latent image to be developed, the developer supply means including magnet means with a plurality of magnetic poles fixed alternately along a circumference thereof, and a metallic cylindrical sleeve which houses the magnet means to be rotated so as to convey the developer by adhering the developer to a surface thereof;

first conveying means, arranged with a specified gap with the developer supply means and arranged above the developer supply means, for conveying the developer in a first longitudinal direction while stirring and supplying to the developer supply means;

second conveying means, provided below the first conveying means, for receiving the developer conveyed from the first conveying means and conveying the developer while stirring in a second longitudinal direction reverse to the first longitudinal direction to circulate between the first conveying means; and housing means for housing the first conveying means and developer so as to supply the developer uniformly to the developer supply means along the first longitudinal direction irrespective of a difference in developer accumulate heights along the first longitudinal direction of conveyance by the first conveying means, the housing means including a leveler inclined downward along the first longitudinal direction and opposed to one of the plurality of magnetic poles of the magnet means.

2. The developing device as set forth in claim 1, wherein the second conveying means is arranged so as to separate residual developer remained on the developer supply means and receive the developer conveyed from the first conveying means.

3. The developing device as set forth in claim 1, wherein the developer supply means further includes:

a doctor blade provided to control a conveying amount of the developer conveyed on the metallic cylindrical sleeve.

4. An image forming apparatus comprising:

means for forming a latent image on an image carrier;

developing means for developing the latent image to obtain a developer image on the image carrier; and transferring means for transferring the developer image from the image carrier to an image receiving medium;

the developing means including:

developer supply means for supplying developer to the latent image to be developed, the developer supply means including magnet means with a plurality of magnetic poles fixed alternately along a circumference thereof, and a metallic cylindrical sleeve which houses the magnet means to be rotated so as to convey the developer by adhering the developer to a surface thereof;

first conveying means, arranged with a specified gap with the developer supply means and arranged above the developer supply means, for conveying the developer in a first longitudinal direction while stirring and supplying to the developer supply means;

second conveying means, provided below the first conveying means, for receiving the developer conveyed from the first conveying means and conveying the developer while stirring in a second longitudinal direction reverse to the first longitudinal direction to circulate between the first conveying means; and housing means for housing the first conveying means and developer so as to supply the developer uniformly to the developer supply means along the first longitudinal direction irrespective of a difference in developer accumulate heights along the first longitudinal direction of conveyance by the first conveying means, the housing means including a leveler inclined downward along the first longitudinal direction and opposed to one of the plurality of magnetic poles of the magnet means.

5. The image forming apparatus as set forth in claim 4, wherein the second conveying means is arranged so as to separate residual developer remained on the developer supply means and receive developer conveyed from the first conveying means.

6. The image forming apparatus as set forth in claim 4, wherein the developer supply means further includes:

a doctor blade provided to control a conveying amount of the developer conveyed on the metallic cylindrical sleeve.

7. A developing device comprising:

a developing roller configured to supply developer to a latent image to be developed, the developing roller including a plurality of magnetic poles;

a first conveying unit, arranged with a specified gap with the developing roller and arranged above the developing roller, to convey the developer in a first longitudinal direction while stirring and supplying to the developing roller;

a second conveying unit, provided below the first conveying unit, to receive the developer conveyed from the first conveying unit and convey the developer while stirring in a second longitudinal direction reverse to the first longitudinal direction to circulate between the first conveying unit; and a housing configured to accommodate the first conveying unit and developer so as to supply the developer uniformly to the developing roller along the first longitudinal direction irrespective of a difference in developer accumulate heights along the first longitudinal direction of conveyance by the first conveying unit, the housing having a leveler inclined downward along the first longitudinal direction and opposed to one of the plurality of magnetic poles of the developing roller.

8. The developing device as set forth in claim 7, wherein the second conveying unit is arranged so as to separate residual developer remained on the developing roller and receive the developer conveyed from the first conveying unit.

9. The developing device as set forth in claim 7, wherein the developing roller further comprises:

a doctor blade provided to control a conveying amount of the developer conveyed on the developing roller.

10. An image forming apparatus comprising:

an image carrier on which a latent image is formed;

a developing device configured to develop the latent image to obtain a developer image on the image carrier; and a transferring device configured to transfer the developer image from the image carrier to an image receiving medium;

the developing device including:

a developing roller configured to supply developer to the latent image to be developed, the developing roller including a plurality of magnetic poles;

a first conveying unit, arranged with a specified gap with the developing roller and arranged above the developing roller, to convey the developer in a first longitudinal direction while stirring and supplying to the developing roller;

a second conveying unit, provided below the first conveying unit, to receive the developer conveyed from the first conveying unit and convey the developer while stirring in a second longitudinal direction reverse to the first longitudinal direction to circulate between the first conveying unit; and a housing configured to accommodate the first conveying unit and developer so as to supply the developer uniformly to the developing roller along the first longitudinal direction irrespective of a difference in developer accumulate heights along the first longitudinal direction of conveyance by the first conveying unit, the housing having a leveler inclined downward along the first longitudinal direction and opposed to one of the plurality of magnetic poles of the developing roller.

11. The image forming apparatus as set forth in claim 10, wherein the second conveying unit is arranged so as to separate residual developer remained on the developing roller and receive developer conveyed from the first conveying unit.

12. The image forming apparatus as set forth in claim 10, wherein the developing roller further comprises:

a doctor blade provided to control a conveying amount of the developer conveyed on the developing roller.

* * * * *